United States Patent [19]

Gipp

[11] Patent Number: 4,595,527

[45] Date of Patent: Jun. 17, 1986

[54] AQUEOUS LAUNDRY PRESPOTTING COMPOSITION

[75] Inventor: Mark M. Gipp, Racine County, Wis.

[73] Assignee: S. C. Johnson & Son, Inc., Racine, Wis.

[21] Appl. No.: 653,865

[22] Filed: Sep. 25, 1984

[51] Int. Cl.[4] ..... C11D 1/40

[52] U.S. Cl. ..... 252/546; 252/143; 252/153; 252/170; 252/171; 252/527; 252/DIG. 11; 252/DIG. 19

[58] Field of Search ..... 252/525, 527, 173, 174.21, 252/153, 143, 544, 546, DIG. 1, DIG. 11, DIG. 14, DIG. 19

[56] References Cited

U.S. PATENT DOCUMENTS

| | | | |
|---|---|---|---|
| 3,956,198 | 5/1976 | Bauer | 252/DIG. 14 |
| 4,079,078 | 3/1978 | Collins | 252/153 |
| 4,438,009 | 3/1984 | Brusky et al. | 252/173 |

*Primary Examiner*—Paul Lieberman
*Assistant Examiner*—John F. McNally

[57] ABSTRACT

An aqueous laundry prespotting composition which is essentially free of solvent, having from 0.1 to 6% of a chelating agent, from 5.0 to 40% by weight of at least one nonionic surfactant, having an HLB in the range of from 9.0 to 13.0 and water. The composition having a pH of from 4.5 to 12.2.

17 Claims, No Drawings

AQUEOUS LAUNDRY PRESPOTTING COMPOSITION

BACKGROUND OF THE INVENTION

This invention relates to laundry prespotting compositions. More particularly this invention relates to aqueous laundry prespotting compositions having excellent stain removal properties.

Current commercially available prespotting compositions fall into two categories, those based primarily upon water and those based primarily upon solvents. The aqueous based prespotting compositions are primarily non-aerosol formulations intended for use in trigger spray bottles or squeeze bottles. These aqueous based prespotting compositions have good stain removal characteristics against the so-called water-borne stains. These stains include grape juice, mustard, grass, chocolate, clay and similar stains.

The solvent based composition formulations typically have been packaged in aerosol form. These solvent-based compositions typically are more effective in removing oil-borne stains, such as cooking oil, fat, spaghetti sauce, sebum, grease, motor oil and the like. It is possible to formulate solvent-based prespotting compositions with reasonable water-borne stain remover. However it is desirable to use a composition which has good removal for both water-borne and oil-borne stains.

There have been attempts to replace the solvent with water in prespotter compositions for both aerosol and non-aerosol formulation types. One approach is described in U.S. Pat. No. 4,438,009, issued Mar. 20, 1984. The compositions described in this patent are emulsions containing a salt, a nonionic surfactant, from 5 to 60% by weight of a solvent, and water. These compositions are described as having good stain removal properties but these compositions require that some solvent be present for the enhanced stain removal.

Another approach is set forth in U.S. Pat. No. 4,079,078, issued Mar. 14, 1978. A typical formulation having certain ingredients corresponding to the teachings of that patent is tested in Example I herein as a comparative formulation. Such compositions require a nonionic surfactant, an anionic surfactant, an alkanolamine, a base, water, a fatty acid corrosion inhibitor, as oleic acid, and optionally, an electrolyte salt to reduce gel formation, such as sodium citrate, and a color stabilizing agent, as citric acid in amounts of up to 1%.

Most commercially available liquid prespotting formulations are totally aqueous. These aqueous formulations exhibit good stain removal for the water-borne stains but are inferior to solvent based prespotters for oil removal.

Most aerosol prespotting formulations and a few liquid formulations are totally non-aqueous. These formulations have excellent oil-borne stain removal but are less effective against water-borne stains. Further, these solvent products often contribute to soil redeposition.

BRIEF DESCRIPTION OF THE INVENTION

It has been suprisingly found that a totally aqueous prespotting composition exhibits good cleaning including oil removal and resoil inhibition under most conditions encountered in the home laundry. This composition comprises a chelating agent, at least one nonionic surfactant and water. These formulations are characterized by being substantially solvent free. The compositions of the present invention are generally liquids of varing viscosities from rather thin compositions suitable primarily for use as pump spray or squeeze bottle spray compositions to rather thick formulations which would have to be spread on the cloth by some alternate method.

OBJECTS AND ADVANTAGES

It is therefore the primary object to the present invention to provide an aqueous liquid prespotting composition having superior cleaning properties for both oil and water-borne stains.

It is the further object of the present invention to provide a laundry prespotting composition containing substantially no solvent.

It is a still further object of the present invention to provide a dispersion prespotting composition, which in a nonsolvent system has cleaning properties equal to or better than solvent containing compositions.

Still further objects and advantages of the composition of the present invention will become more apparent from the following more detailed description thereof.

DETAILED DESCRIPTION OF THE INVENTION

The laundry prespotting compositions of the present invention comprise from about 0.1 to 6% by weight of a chelating agent; from about 5 to 40% by weight of at least one nonionic surfactant, said surfactant having HLB such that the combined HLB of the nonionic surfactants is within the range of from 9 to 13; and the balance of the composition comprising water wherein said composition is substantially solvent-free and has a pH of from about 4.5 to 12.2.

The first component of the compositions to the present invention is a chelating agent. It is thought that the chelating agent functions in the composition to the present invention to assist in removal of certain heavy ions which inhibit the surfactancy of the nonionic surfactants. Also these chelating agents act in concert with the nonionic surfactant so that the surfactant is in the right configuration to attack oily stains from an aqueous system. Suitable chelating agents include the salts of ethylenediamine tetraacetic acid (EDTA) such as ethylenediaminetetraacetic acid disodium salt, ethylenediaminetetraacetic acid diammonium salt, ethylenediaminetetraacetic acid trisodium salt, ethylenediaminetetraacetic acid tetrasodium salt, ethylenediaminetetraacetic acid tetrapotassium salt, ethylenediaminetetraacetic acid tetrammonium salt, etc., the salts of diethylenetriaminepentaacetic acid (DTPA) such as diethylenetriaminepentaacetic acid pentasodium salt, diethylenetriaminepentaacetic acid pentapotassium salt, etc., the salts of (N-hydroxyethyl) ethylenediaminetriacetic acid (HEDTA) such as (N-hydroxyethyl) ethylenediaminetriacetic acid trisodium salt, (N-hydroxyethyl) ethylenediaminetriacetic acid tripotassium salt, etc., the salts of nitrilotriacetic acid (NTA) such as nitrilotriacetic acid trisodium salt, nitrilotriacetic acid tripotassium salt, etc., other chelating agents such as triethanolamine, diethanolamine, monoethanolamine, etc. and mixtures thereof. Preferred chelating agents are the EDTA and the NTA type chelating agents especially the salts of ethylenediaminetretraacetic acid and particularly the tetrasodium, trisodium and disodium salts of ethylenediaminetetraacetic acid.

Typically the chelating agents are present in the composition of the present invention in an amount of from about 0.1 to 6% by weight. It is within this weight range that the optimum cleaning and prespotting efficiency is obtained. It is perferred that the chelating agents be present in the amount of from about 1.0 to 4% by weight and preferable from 1.5 to 3.0% by weight.

The chelating agents, especially the EDTA, DTPA, and HEDTA types, can be added to the composition of the present invention in the salt form, which is prefered since the salts are water soluble, or in the water insoluble free acid form. If the chelating agents are added in the free acid form, the free acids must be at least partially neutralized to make them water soluble and form the chelating agent salts in situ. Suitable bases to neutralize the free acids are sodium hydroxide, potassium hydroxide and ammonium hydroxide. Sufficient base is added to solublize the free acid chelating agent and to bring the pH of the composition within the range of about 4.5 to 12.2.

If the chelating agents are added as salts, these salts are often quite basic, having a pH often above 10. It may be necessary to add some acid or other pH buffering material to the composition of the present invention to adjust the pH to within a range of from 4.5 to 12.2 and preferably 6.5 to 8.5 and optimum 7 to 8. Suitable acids include citric acid, oxalic acid, acetic acid, hydrochloric acid, phosphoric, and the like. The primary function of the acid is to control the pH so that the chelating agent and the surfactants can remove the stains from the fabrics. Certain organic acids also have some chelating properties and therefore may contribute to the overall cleaning efficiency of the prespotting composition. Generally the acids, if used, are present in the compositions in the amount of from 0.2 to 2% by weight, however the amount of acid used is not critical. The preferred acid is citric acid.

Citric acid may also be employed as a chelating agent, since it possesses chelating properties. For this purpose it is employed in chelating amounts from about 1.0 to 4.0% by weight and, preferably, from 1.5 to 3.0% by weight. A suitable base can be employed to adjust the pH of the composition to within the preferred range from 6.5 to 8.5 and, optimally, between 7 and 8.

Accordingly, citric acid may be employed herein as a first component of the inventive composition to assist in removing heavy ions and/or to act in concert with the nonionic surfactant to aid in attacking oily stains. If desired, it is also employed in combination with other chelating agents of the invention, to assist in controlling the final pH of the composition, when such other chelating agents are added as salts.

The compositions of the present invention also include at least one nonionic surfactant. A single nonionic surfactant having an appropriate HLB can be utilized or mixtures of nonionic surfactants such that the HLB of the resulting mixture of nonionic surfactants is within the appropriate range. It has generally been found that the nonionic surfactant or mixture of nonionic surfactants should have an HLB within the range of from 9 to 13 for optium efficiency. It is perferred that the HLB be between 10 and 12. The optimum HLB range is from 10.5 to 11.5.

Suitable nonionic surfactants include the ethoxylated nonylphenols such as the Surfonic N series available from Texaco Chemicals; and the ethoxylated octylphenols including the Triton X series available from Rohm & Haas; the ethoxylated secondary fatty alcohols such as the Tergitol series available from Union Carbide; the ethoxylated primary fatty alcohols such as the Neodols available from Shell Chemicals; the ethoxylated sorbitan fatty acid esters such as the Tweens from ICI America and the sorbitan fatty acid esters such as the Spans from ICI America.

The perferred surfactants include the ethoxylated nonylphenols especially those having a degree of ethyloxylation of from 3 to 10 moles of ethylene oxide, the ethoxylated octylphenols expecially those having from 3 to 10 moles of ethylene oxide and the ethoxylated fatty secondary alcohols especially those having from 3 to 10 moles of ethylene oxide. As noted above mixtures of nonionic surfactants, which individually have an HLB outside the range, can be utilized so long as the resultant HLB value of the mixture is within the range as set forth above. It is within this HLB range that the stain removal properties of the composition of the present invention are at a maximum. Outside this range there is not sufficient oil and water dispersibility to provide suitable stain removing properties. Generally it has been found that the nonionic surfactants which are water dispersible have the best stain removal properties in the compositions of the present invention. It is thought that water dispersible surfactants act both against oil and water borne stains.

Generally the composition should include from 5 to 40% by weight of at least one nonionic surfactant and preferably from 5 to 20% by weight and optimally 7 to 20% by weight of at least one nonionic surfactant.

The compositions of the present invention are characterized as being substantially solvent free. By the term "substantially solvent free" is meant a composition which contains less than 1% by weight of an organic water immiscible solvent such as isoparaffinic hydrocarbons, deodorized kerosene, d-limonene, the chlorinated solvents such as perchloroethylene, methylene chloride, etc., This term is meant to exclude those nonpolar water insoluble solvents typically used in stain removal compositions.

The compositions of the present invention can also include small additional amounts of other conventional materials including perfumes, defoamers, bacteriacides, bacterstats and the like. Generally these materials are present in amounts of less than 2% by weight based on the amount of the composition.

Although the compositions of the present invention are primarily designed for use as prespotting compositions, these compositions can also be used as laundry detergents or cleaning agents. These compositions can be used as heavy duty liquid laundry cleaning compositions.

The compositions of the present invention can be prepared by any conventional means. Suitable methods include cold blending or other mixing processes. It is not necessary to use high shear or other strenuous mixing techniques to prepare the compositions of the present invention.

The prespotting compositions of the present invention will now be illustrated by way of the following examples where all part percentages are by weight and all temperatures and degrees celeius unless otherwise indicated.

EXAMPLE A

An artificial sebum soil was prepared as follows:

| | Weight (Gms) |
|---|---|
| **Part A** | |
| Palmitic Acid | 5.0 |
| Stearic Acid | 2.5 |
| Coconut Oil | 7.5 |
| Paraffin | 5.0 |
| Spermaceti | 7.5 |
| Olive Oil | 10.0 |
| Squalene | 2.5 |
| Chloresterol | 2.5 |
| Oleic Acid | 5.0 |
| Linoleic Acid | 2.5 |
| | 50.0 |
| **Part B** | |
| Oleic Acid | 4.0 gms. |
| Triethanolamine | 8.0 gms. |

Melt all the components of Part A together at 120°–130° F. Add Part B to Part A with agitation while hot until homogeneous. At this time, 12 grams of air filter dirt (+200 mesh) is added and agitated for 10 minutes. From 50–100 ml of 120° F. deionized water is added with agitation and stirred for 10 minutes. From 900–950 ml (to total 1000 ml) of 120° F. deionized water is added and agitated until the temperature of the mixture drops to 110° F. The mixture is agitated in a Gifford Wood Homogenizer for 10 minutes or until 120° F. Pour the mixture through cheesecloth and store in 100° F. oven.

EXAMPLE B

Grass stain slurry is prepared by placing 50 grams of fresh grass clippings and 500 grams of water in a blender and gradually increasing the speed to "liquify". Add isopropyl alcohol as needed (up to 50 grams) to reduce foaming and blend for 20 minutes. Add remainder of isopropyl alcohol (to 50 grams total) and mix for 5 minutes. Strain through a 40 mesh screen and keep refrigerated until use.

EXAMPLE 1

A liquid prespotting composition having the following composition was prepared:

| | |
|---|---|
| Water | 84.1%, |
| Nonylphenol ethyloxylate (6 moles ethylene oxide) (Surfonic N-60) | 10% |
| Ethylenediaminetetraacetic acid, tetrasodium salt (40% actives) | 5% |
| Citric acid (50% actives) | 0.9% |
| | 100.0% |

This formulation was mixed and then placed into a squeeze bottle having a fountain type cap for testing. The composition had a pH of 7.9. The formulation was tested on 4 types of white cloth swatches: 100% cotton, 65/35 polyester/cotton, 50/50 polyester/cotton, and 100% polyester. Each swatch was stained with 7 stains, used motor oil, mustard, grape juice, chocolate, a 20% clay slurry, artificial sebum, (Example A), and grass slurry (Example B). The swatches were saturated with the above formulation and allowed to sit for 1 minute. The swatches were then washed with Tide detergent available from Procter & Gamble with a dummy load of cotton towels. The stain removal characteristics were rated on a 5 point scale with 1 being essentially no removal and 5 being complete removal. The above formulation is compared to a liquid prespotter formulation (comparative) containing 2% sodium citrate, 8% of a $C_{12}$–$C_{15}$ ethoylated alcohol (7 moles ethylene oxide), 2.4% sodium xylene sulfonate and 87.6% water. The results are shown in Table 1.

TABLE 1

| | 100% Cotton | | 65 Polyester/ 35 Cotton | | 50 Polyester/ 50 Cotton | | 100% Polyester | |
|---|---|---|---|---|---|---|---|---|
| Stain | Ex. 1 | Comp. | Ex. 1 | Comp. | Ex. 1 | Comp. | Ex. 1 | Comp. |
| Used Oil | 2.5 | 1 | 2 | 1 | 2.5 | 1.5 | 2 | 1 |
| Mustard | 2 | 2 | 5 | 5 | 4 | 4 | 5 | 5 |
| Grape juice | 4 | 1 | 4.5 | 4 | 4.5 | 4 | 5 | 5 |
| Chocolate | 1 | 1 | 5 | 5 | 4.5 | 4.5 | 5 | 5 |
| Clay | 1 | 1 | 5 | 5 | 4 | 4 | 5 | 4.5 |
| Grass | 3 | 3 | 3 | 3 | 3 | 3 | 5 | 5 |
| Sebum | 3.5 | 4 | 4.5 | 4.5 | 5 | 5 | 5 | 5 |
| Composite | 2.50 | 1.85 | 4.07 | 3.93 | 3.93 | 3.71 | 4.57 | 4.29 |

The formulation of Example 1 had a composite stain removal of approximately 3.75 for all four cloth types while the comparative composition had a composite of 3.46. The stain removal scores for both formulations are about equal for all stains except used motor oil. For this stain the comparitive formula did not remove the stain for any cloth type while the formulation of Example 1 showed improved oil stain removal.

EXAMPLE 2

The procedure of Example 1 is repeated except that the formulation is changed as shown in Table 2. The formulations are tested in accordance with the procedure of Example 1. As the stain removal scores for stains other than used motor oil are essentially equivalent only the results showing the increased used motor oil removal are shown in Table 2.

TABLE 2

| RUN | A | B | C |
|---|---|---|---|
| Water | 88.1 | 86.1 | 82.1 |
| Surfonic N-60[1] | 6.0 | 8.0 | 12.0 |
| $Na_4$ EDTA (40%)[2] | 5.0 | 5.0 | 5.0 |
| Citric Acid (50%) | 0.9 | 0.9 | 0.9 |
| Used Oil Removal[3] | | | |
| Cotton | 1.5 | 2 | 3 |
| 65 Poly/35 Cotton | 1 | 1.5 | 2 |
| 50 Poly/50 Cotton | 2 | 2 | 3 |
| Polyester | 1.5 | 2 | 2 |

[1]Surfonic N-60 — Same as used in Example 1.
[2]$Na_4$ — Tetrasodium Salt of Ethylenediaminetetraacetic Acid.
[3]Used Oil Removal — Used Motor Oil Removal as per test described in Example 1.

As it is apparent from the above, increasing the surfactant level increases the ability of the formulation to remove used motor oil from a variety of fabrics.

EXAMPLE 3

The procedure of Example 1 is followed with the exception that the formulations as shown in Table 3 were prepared. For comparison, similar formulations were prepared without the tetrasodium salt of ethylenediamenetetraacedic acids. As the only substantial differences between the formulations in stain removal is in the used motor oil removal, this was also shown in Table 3.

TABLE 3

| RUN | A | B | C | D[4] | E[4] | F[4] |
|---|---|---|---|---|---|---|
| Water | 74.1 | 69.1 | 64.1 | 80 | 75 | 70 |
| Surfonic N-60[1] | 20 | 25 | 30 | 20 | 25 | 30 |
| $Na_4$ EDTA (40%)[2] | 5.0 | 5.0 | 5.0 | — | — | — |
| Citric Acid (50%) | 0.9 | 0.9 | 0.9 | — | — | — |
| Used Oil Removal[3] | | | | | | |
| Cotton | 3 | 3.5 | 4 | 2 | 2 | 3 |
| 65 Poly/35 Cotton | 2 | 3 | 3.5 | 1 | 1.5 | 2 |
| Polyester | 3 | 4 | 3 | 2 | 3 | 2.5 |

[1-3]As in Table 2.
[4]Comparative

EXAMPLE 4

Procedure of Example 1 is repeated with the exception that the formulations used in Table 4 were run.

TABLE 4

| RUN | A | B | C | D |
|---|---|---|---|---|
| Water | 84.1 | 84.1 | 84.1 | 84.1 |
| Surfonic N-60[1] | 9.5 | 9.25 | 9 | 8.5 |
| Surfonic N-31.5[4] | 0.5 | 0.75 | 1 | 1.5 |
| $Na_4$ EDTA (40%)[2] | 5.0 | 5.0 | 5.0 | 5.0 |

TABLE 4-continued

| RUN | A | B | C | D |
|---|---|---|---|---|
| Citric Acid (50%) | 0.9 | 0.9 | 0.9 | 0.9 |
| Used Oil Removal[3] | | | | |
| Cotton | 3.5 | 3.5 | 3.5 | 3.8 |
| 65 Poly/35 Cotton | 1.5 | 1.5 | 1.5 | 1 |
| 50 Poly/50 Cotton | 2 | 1.5 | 1.5 | 1.5 |
| Polyester | 2.5 | 1.5 | 1 | 1 |

[1-3]As in Table 2
[4]Surfonic N-31.5 — Nonylphenol Ethoxylate (3.5 moles ethylene oxide)

As apparent from Table 4, inclusion of small amounts of the surfactants can increase the oil removal against cotton but can effect its oil removal for other types of cloth.

EXAMPLE 5

In order to show the effect of different levels of chelating agent, the formulations in Table 5 were prepared and tested using the procedure of Example 1.

TABLE 5

| RUN | A | B | C | D | E | F | G | H[4] |
|---|---|---|---|---|---|---|---|---|
| Water | 89.705 | 89.262 | 88.525 | 81.15 | 78.2 | 72.25 | 72.3 | 90 |
| $Na_4$ EDTA (40%)[2] | 0.25 | 0.625 | 1.25 | 7.5 | 10.0 | 12.5 | 15.0 | |
| Surfonic N-60[1] | 10 | 10 | 10 | 10 | 10 | 10 | 10 | 10 |
| Citric Acid (50%) | 0.045 | 0.113 | 0.225 | 1.35 | 1.8 | 2.25 | 2.7 | |
| Used Oil Removal[3] | | | | | | | | |
| Cotton | 1.5 | 1.5 | 1.5 | 2.5 | 2.0 | 2 | 1 | 1 |
| 65 Poly/35 Cotton | 1 | 1.5 | 1.5 | 2 | 2 | 1 | 1 | 1 |
| Polyester | 1.5 | 2 | 1.5 | 2 | 1.5 | 1.5 | 1.5 | 1.5 |

[1-3]As in Table 2.
[4]Comparative

As it is apparent from Table 5, at a level of from approximately 0.5 to about 4% is optimum for best oil removal. Although at very low levels and higher levels of EDTA some oil removal can be seen. In each of the formulations the citric acid was adjusted to maintain the pH at approximately 7.9.

EXAMPLE 6

In order to show the effect of different chelating agents the formulations shown in Table 6 were prepared. In some cases the pH was adjusted, while in other cases the pH of the material by itself was used.

TABLE 6

| Run | A | B | C | D | E | F | G | H | I | J | K |
|---|---|---|---|---|---|---|---|---|---|---|---|
| Water | 84.1 | 84.1 | 88 | 85 | 85 | 85 | 85 | 85 | 84.1 | 84.1 | 84.1 |
| Surfonic N-60[1] | 10 | 10 | 10 | 10 | 10 | 10 | 10 | 10 | 10 | 10 | 10 |
| $Na_4$ EDTA (40%)[2] | 2.5 | | | | | | | | | | |
| $Na_3$ NTA (40%)[4] | 2.5 | 5.0 | | | | | | | | | |
| $Na_2$ EDTA[5] | | | 2.0 | | | | | | | | |
| $(NH_4)_4$ EDTA (40%)[6] | | | | 5.0 | | | | | | | |
| $(NH_4)_2$ EDTA (40%)[7] | | | | | 5.0 | | | | | | |
| $Na_5$ DTPA (40%)[8] | | | | | | 5.0 | | | 5.0 | | |
| $Na_3$ HEDTA (40%)[9] | | | | | | | 5.0 | | | 5.0 | |
| Triethanolamine | | | | | | | | 5.0 | | | 5.0 |
| Citric Acid (50%) | 0.9 | 0.9 | | | | | | | P[10] | P | P |
| Used Oil Removal[3] | | | | | | | | | | | |
| Cotton | 3.5 | 3.5 | 3.5 | 3.5 | 3 | 3.5 | 3.5 | 3 | 3.5 | 3.5 | 3.5 |
| 65 Poly/35 Cotton | 2 | 2 | 1.5 | 1.5 | 1.5 | 2 | 2 | 1 | 2 | 1.5 | 2 |
| Polyester | 1.5 | 1.5 | 1.5 | 2 | 1.5 | 2 | 2 | 1 | 1.5 | 1.5 | 2 |
| pH | 7.85 | 8.3 | 4.75 | 8.9 | 4.5 | 12.1 | 12 | 9.8 | 7.6 | 7.2 | 8 |

[1-3]As in Table 2
[4]Trisodium salt of nitrilotriacetic acid
[5]Disodium salt of ethylenediaminetetraacetic acid
[6]Tetraammonium salt of ethylenediaminetetraacetic acid
[7]Diammonium salt of ethylenediaminetetraacetic acid
[8]Pentasodium salt of diethylenetriaminepentaacetic acid
[9]Trisodium salt of (N—hydroxyethyl) ethylenediaminetriacetic acid
[10]P = to pH as listed below

EXAMPLE 7

In order to show the effect of varying acids used to adjust the pH, the formulations shown in Table 7 were prepared, using the procedure of Example 1. These formulations were also tested as in Example 1.

TABLE 7

| RUN | A | B | C | D | E | F |
|---|---|---|---|---|---|---|
| Water | 84.1 | 84.1 | 84.1 | 84.1 | 84.1 | 84.1 |
| Surfonic N-60[1] | 10 | 10 | 10 | 10 | 10 | 10 |
| $Na_4$ EDTA (40%)[2] | 5 | 5 | 5 | 5 | 5 | 5 |
| Phosphoric Acid (85%) | | P[4] | | | | |
| Oxalicacid | | | 0.5 | | | |
| Boric Acid | | | | 2.6 | | |
| Hydrochloric Acid | | | | | P | |
| Glacial Acetic | | | | | | P |
| pH | 12 | 7.7 | 6.6 | 8.0 | 7.6 | 7.6 |
| Used Oil Removal[3] | | | | | | |
| Cotton | 3.5 | 4 | 3.5 | 3 | 3 | 3.5 |
| 65 Poly/35 Cotton | 2 | 2 | 2 | 2 | 2 | 2 |
| 50 Poly/50 Cotton | 2 | 2 | 2 | 2 | 2 | 2 |
| Polyester | 2.5 | 2.5 | 2 | 2.5 | 2.5 | 2.5 |

[1-3]As in Table 2.
[4]P = to pH listed below.

EXAMPLE 8

The procedure in formulation of Example 1 was prepared with the exception that the surfonic N60 was replaced with the following surfactants:

| RUN | SURFACTANT |
|---|---|
| A | Nonylphenol ethoxylate 5 moles ethylene oxide - Igepal CO-520 |
| B | 3 parts nonylphenol ethoxylate (4 moles ethylene oxide) (Surfonic N-40) - 2 parts nonylphenol ethoxylate (9.5 moles ethylene oxide) (Surfonic N-95) |
| C | 2 parts Surfonic N-60 - 3 parts secondary alcohol ethoxylate (5 moles ethylene oxide) (Tergitol 15-S-5) |
| D | Tergitol 15-S-5 |
| E | Octylphenol ethoxylate (4.5 moles ethylene oxide) (Triton X-45) |
| F | 2 parts C12–15 linear alcohol ethoxylate (7 moles ethylene oxide) (Neodol 25-7) - 1 part C12–15 linear alcohol ethoxylate (3 moles ethylene oxide) (Neodol 25-3) |
| G | 1 part sorbitanmonoleate ethoxylate (20 moles ethylene oxide) (Tween 80) - 2 parts Surfonic N-40 |
| H | 1 part Tween 80 - 4 parts Surfonic N-40 |

The oil removal scores are shown in Table 8.

TABLE 8

| RUN | A | B | C | D | E | F | G | H |
|---|---|---|---|---|---|---|---|---|
| 1st Wash | | | | | | | | |
| Cotton | 3.5 | 3 | 4 | 4 | 2.5 | 4 | 3.5 | 2.5 |
| 65 Poly/35 Cotton | 2 | 2 | 3 | 2 | 2 | 1.5 | 1.5 | 2 |
| 50 Poly/50 Cotton | 2 | 1 | 2 | 2 | 1 | 2 | 1.5 | 1 |
| Polyester | 1.5 | 1.5 | 1.5 | 1.5 | 1.5 | 1 | 1 | 1 |
| 2nd Wash | | | | | | | | |
| Cotton | 4.5 | 4.5 | 4.5 | 4.5 | 4.5 | 4.5 | 4.5 | 4.5 |
| 65 Poly/35 Cotton | 3.5 | 3.5 | 3.5 | 2.5 | 2.5 | 2.5 | 3 | 2.5 |
| 50 Poly/50 Cotton | 3 | 3 | 3 | 2 | 2 | 3 | 3 | 1.5 |
| Polyester | 2.5 | 2.5 | 2 | 1.5 | 1.5 | 1.5 | 2 | 1.5 |

EXAMPLE 9

The procedure of Example 1 is repeated with the following formulation:

| | |
|---|---|
| Water | 86.09% |
| Nonylphenol ethoxylate | 10.00% |
| Citric acid (50% actives) | 2.40% |
| Sodium hydroxide (50% soln) | 1.51% |
| | 100.00% |

The pH of the formulation is between 7 and 8. The formulation is effective in removing stains as set forth in Example 1.

What I claim is:

1. A laundry pre-spotting composition consisting essentially of:

(a) from about 0.1 to 6% by weight of a chelating agent;

(b) from about 5 to 40% by weight of at least one nonionic surfactant selected from the group consisting of ethoxylated nonylphenols, ethoxylated octylphenols, ethoxylated secondary fatty alcohols, ethoxylated primary fatty alcohols, ethoxylated sorbitan fatty acid esters, sorbitan fatty acid esters, and mixtures thereof, wherein the surfactant has an HLB such that the combined HLB for all surfactants present is within the range of from 9 to 13; and (c) water, wherein the composition has less than 1% by weight of an organic water immiscible and nonpolar water insoluble solvent and wherein the composition has a pH within the range of from about 4.5 to 12.2.

2. The composition of claim 1 wherein the chelating agent is selected from the group consisting of salts of ethylenediaminetetraacetic acid, salts of diethylenetriaminepentaacetic acid, salts of (N-hydroxyethyl) ethylenediaminetriacetic acid, salts of nitrilotriacetic acid, triethanolamine, diethanolamine, monoethanolamine, and mixtures thereof.

3. The composition of claim 1 wherein the chelating agent is present in an amount of from 1.0 to 4.0% by weight.

4. The composition of claim 1 wherein the chelating agent is present in an amount of from 1.5 to 3.0% by weight.

5. The composition of claim 1 wherein the chelating agent is selected from the group consisting of salts of ethylenediaminetetraacetic acid, salts of diethylenetriaminepentaacetic acid, salts of (N-hydroxyethyl) ethylenediaminetriacetic acid, salts of nitrilotriacetic acid and mixtures thereof.

6. The composition of claim 1 wherein the chelating agent is selected from the group consisting of ethylenediaminetetraacetic acid disodium salt, ethylenediaminetetraacetic acid diammonium salt, ethylenediaminetetraacetic acid dipotassium salt, ethylenediaminetetraacetic acid tripotassium salt, ethylenediaminetetraacetic acid trisodium salt, ethylenediaminetetraacetic acid tetrasodium salt, ethylenediaminetetraacetic acid tetrapotassium salt, ethylenediaminetetraacetic acid tetrammonium salt, nitrilotriacetic acid trisodium salt, nitrilotriacetic acid tripotassium salt, and mixtures thereof.

7. The composition of claim 1 wherein the chelating agent is selected from the group consisting of ethylenediaminetetraacetic acid tetrasodium salt, ethylenediaminetetraacetic acid trisodium salt, ethylenediaminetetraacetic acid disodium salt, and mixtures thereof.

8. The composition of claim 1 wherein the chelating agent is citric acid.

9. The composition of claim 1 wherein the composition includes an effective amount of an acid sufficient to adjust the pH of the composition to within the range of 4.5 to 12.2.

10. The composition of claim 1 wherein the composition has a pH within the range of from 6.5 to 8.5.

11. The composition of claim 1 wherein the composition has a pH within the range of from 7.0 to 8.0.

12. The composition of claim 1 wherein the HLB range is from 10 to 12.

13. The composition of claim 1 wherein the HLB range is from 10.5 to 11.5.

14. The composition of claim 1 wherein the surfactants are present in the amount from 5.0 to 20.0% by weight.

15. The composition of claim 1 wherein the surfactants are present in the amount from 7.0 to 20.0% by weight.

16. A laundry pre-spotting composition comprising:

(a) from about 1.0 to 4.0% by weight of a chelating agent selected from the group consisting of salts of ethylenediaminetetraacetic acid, salts of diethylene, triamine, pentaacetic acid, salts of (N-hydroxyethyl) ethylenediaminetriacetic acid, salts of nitrilotriacetic acid and mixtures thereof;

(b) from about 5 to 20% by weight of at least one nonionic surfactant selected from the group consisting of ethoxylated nonylphenols, ethoxylated octylphenols, ethoxylated secondary fatty alcohols, ethoxylated primary fatty alcohols, ethoxylated sorbitan fatty acid esters, sorbitan fatty acid esters and mixtures thereof, wherein surfactant has an HLB such that the combined HLB for all surfactants present is within the range of from 10 to 12; and (c) water;

wherein the composition has less than 1% by weight of an organic water immiscible and non-polar water insoluble solvent and wherein the composition has a pH within the range of 6.5 to 8.5.

17. A laundry prespotting composition comprising:

(a) from about 1.0 to 4.0% by weight of citric acid;

(b) from about 5 to 20% by weight of a nonionic surfactant having an HLB such that the combined HLB for all surfactants present is within the range from 10 to 12, said surfactant selected from the group consisting of ethoxylated nonylphenols, ethoxylated octylphenols, ethoxylated secondary fatty alcohols, ethoxylated primary fatty alcohols, ethoxylated sorbitan fatty acid esters, sorbitan fatty acid esters and mixtures thereof; and (c) water the composition immiscible and non-polar water insoluble solvent and having a pH from 6.5 to 8.5.

* * * * *

UNITED STATES PATENT AND TRADEMARK OFFICE

CERTIFICATE OF CORRECTION

PATENT NO. : 4,595,527

DATED : June 17, 1986

INVENTOR(S) : Mark M. Gipp

It is certified that error appears in the above-identified patent and that said Letters Patent is hereby corrected as shown below:

In Claim 17, Column 12, Line 26, after the word "composition", insert --has less than 1% by weight of an organic water--.

Signed and Sealed this

Sixteenth Day of February, 1988

*Attest:*

DONALD J. QUIGG

*Attesting Officer*

*Commissioner of Patents and Trademarks*